US008587188B1

(12) United States Patent
Ingram et al.

(10) Patent No.: US 8,587,188 B1
(45) Date of Patent: Nov. 19, 2013

(54) LIGHT-EMITTING ELEMENT BASED ON LASER CARBONIZED POLYMER SUBSTRATE

(75) Inventors: John M. Ingram, Moscow, ID (US); Augustus W. Fountain, III, Bel Air, MD (US); Thomas M. Spudich, Lake Saint Louis, MO (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 13/407,301

(22) Filed: Feb. 28, 2012

Related U.S. Application Data

(63) Continuation-in-part of application No. 12/768,315, filed on Apr. 27, 2010, now abandoned.

(51) Int. Cl.
*H01J 1/00* (2006.01)
*H01J 19/06* (2006.01)

(52) U.S. Cl.
USPC ..... 313/311

(58) Field of Classification Search
None
See application file for complete search history.

(56) References Cited

U.S. PATENT DOCUMENTS

| | | | | |
|---|---|---|---|---|
| 4,395,244 | A * | 7/1983 | Glaser | 445/25 |
| 6,057,532 | A * | 5/2000 | Dexter et al. | 219/553 |
| 6,796,166 | B1 * | 9/2004 | Fountains et al. | 73/29.05 |
| 2008/0128493 | A1 * | 6/2008 | Jones et al. | 235/380 |

* cited by examiner

*Primary Examiner* — Donald Raleigh
(74) *Attorney, Agent, or Firm* — Ulysses John Biffoni

(57) ABSTRACT

An infrared radiation emitting element is provided. A carbonized conducting filament is formed from an insulating substrate material. Passing current through the filament produces radiation in the infrared band. The radiation emitted is tuned by altering the physical or chemical characteristics of the filament. A substrate is optionally doped prior to filament formation. Alternatively, or in addition, a post-filament formation doping process is used. The light-emitting element is a durable, low power IR emitter that is operable as a marker.

17 Claims, 2 Drawing Sheets

LIGHT-EMITTING ELEMENT BASED ON LASER CARBONIZED POLYMER SUBSTRATE

RELATED APPLICATION

This application is a Continuation-In-Part of U.S. patent application Ser. No. 12/768,315 filed on Apr. 27, 2010, now abandoned which is incorporated herein by reference.

GOVERNMENT INTEREST

The invention described herein may be manufactured, used and licensed by or for the U.S. Government.

FIELD OF THE INVENTION

The invention is generally related to light-emitting sources and in particular to a light-emitting element that emits light in the infrared region and includes a carbonized conducting filament formed from and bonded to an insulating substrate such as a polyimide.

BACKGROUND OF THE INVENTION

Infrared (IR) emission sources are useful for a variety of applications. IR emission sources are commonly used for both military and law enforcement purposes. Historical methods of emitting IR radiation for marking purposes such as ordnance targeting utilized a pouch containing chemicals that underwent an exothermic reaction on exposure to air to generate heat, and therefore infrared energy, for a period of time. These prior art systems suffered numerous drawbacks including single use, rapid chemical depletion and generation of chemical waste.

Chemical IR emitters have been replaced by IR emitting lamps. IR emitting lamps address several of the drawbacks of chemical emitters and are sufficient to be detected by optical equipment. Typical lamps that emit radiation in the near infrared (NIR) and far infrared (FIR) include a tungsten filament lamp, silicon carbide, or a xenon arc lamp. These lamps and other prior art IR emission sources suffer from low inherent efficiency, which is usually much less than 1 percent. Further, the tungsten filament lamp is susceptible to degradation through oxidation if operated in air and, like the xenon arc lamp, must be encased in a sealed vacuum chamber. Vacuum encasing drives up costs and decreases ruggedness. While the tungsten filament and xenon arc lamps have relatively fast rise times for IR emission, the tungsten filament has a slow decay time. Silicon carbide elements have slow rise and fall times. This hinders their use as identification or reference sources. Both tungsten and xenon arc lamps must also be filtered to achieve IR only emissions. Thus, xenon arc or silicon carbide lamps are optimally used in limited conditions such as where high emission sources are required. However, for applications where high IR emission density is not required or where only low power is available, the traditional lamp sources are not optimal.

Thus, there exists a need for a low power, high efficiency infrared radiation emitter.

SUMMARY OF THE INVENTION

The following summary of the invention is provided to facilitate an understanding of some of the innovative features unique to the present invention and is not intended to be a full description. A full appreciation of the various aspects of the invention can be gained by taking the entire specification, claims, drawings, and abstract as a whole.

A light-emitting element is provided that includes a substrate comprising a polymer upon which at least one carbonized conductive filament is formed. The carbonized conductive filament is formed from the substrate. In a preferred embodiment, the filament is formed by the polymer being laser carbonized.

A substrate is preferably a polyimide or other insulating plastic material. A filament is preferably formed within an atmosphere that is oxygen, nitrogen, helium, other inert gas, or combinations thereof. Preferably, the formation atmosphere is a nitrogen atmosphere or a combination of nitrogen and oxygen. A preferred atmosphere is devoid of other gases.

An inventive element preferably emits radiation between about 1 and 20 micrometers with an emission response time of less than 1 second.

The width of a carbonized conductive filament is from about 1 micrometer to 500 micrometers. Preferably, the height of the carbonized conductive filament is from about 1 micrometer to about 200 micrometers. The filament has an input to output power ratio greater than 1 percent. Light emission from the filament is from 0.5 microns to about 50 microns. Preferably, emitted light is from about 0.75 microns to about 20 microns.

The filament is preferably formed on a substrate that has been subjected to a pre-dopant processing or a post-dopant processing. The inventive filament is optionally formed on the substrate in the shape of an indicia such as a symbol or an alphanumeric character.

The inventive element also includes a backing. Additionally an inventive element includes a cover of an infrared transparent material. Optionally the cover or backing is insulating. An inventive element also includes a heat-reflective layer.

An inventive element includes one or more electrically conducting filaments. The filaments are optionally arranged as to form parallel circuits.

DETAILED DESCRIPTION OF THE PREFERRED EMBODIMENTS

Figure 1:
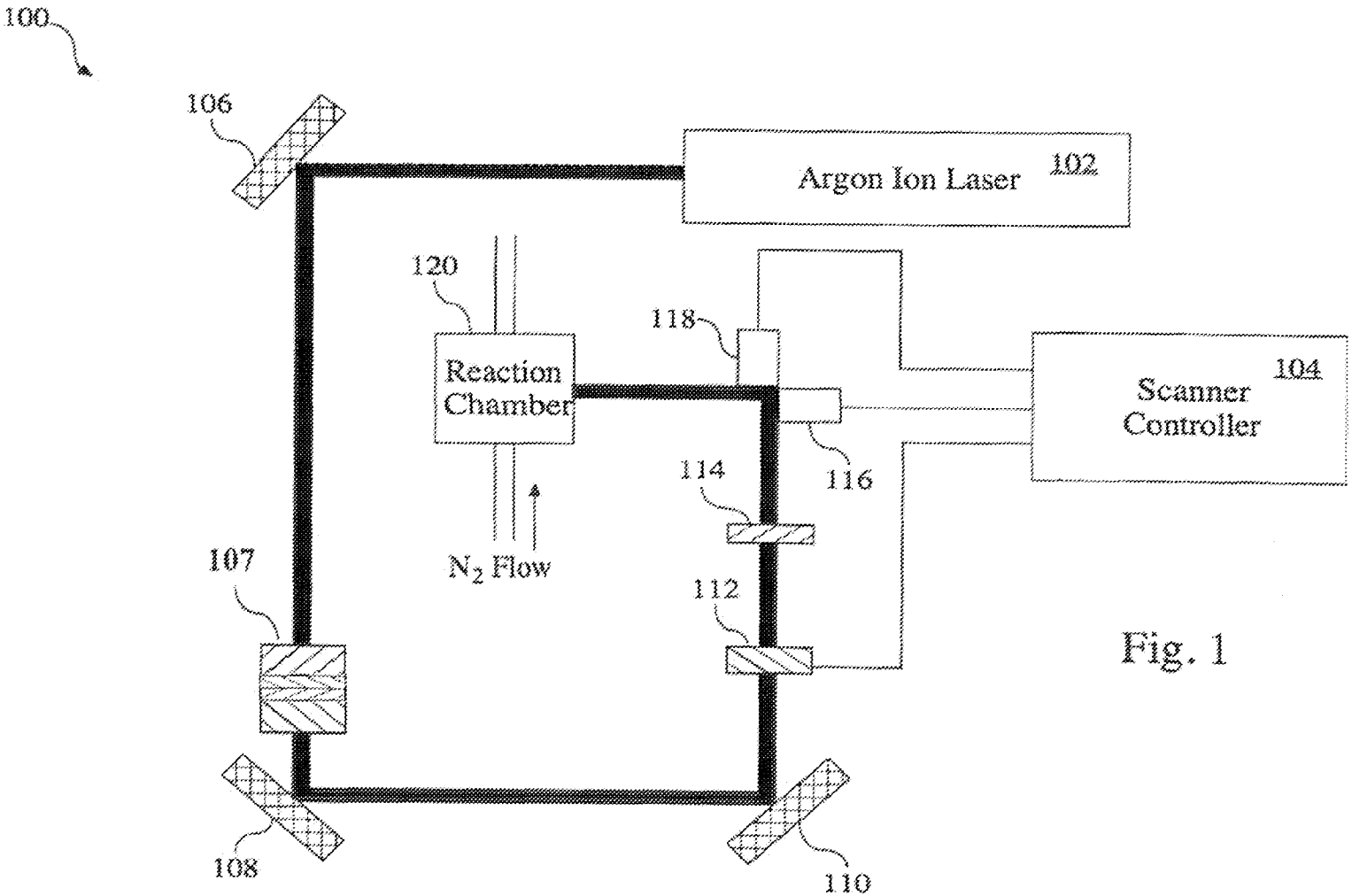
FIG. 1 illustrates a schematic diagram 100 illustrating a design for the laser pyrolysis of a polymer for use as a filament and attached substrate, in accordance with a preferred embodiment of the present invention.
Figure 2:
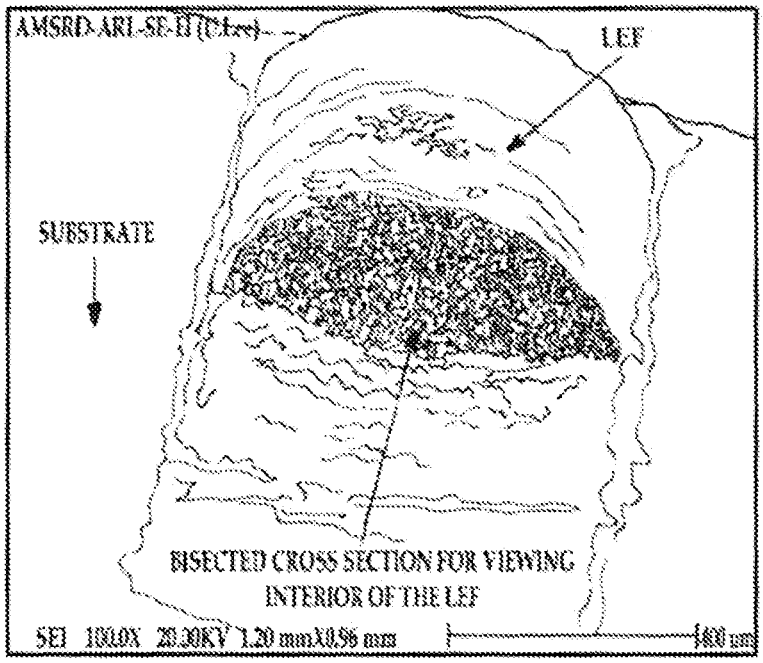
FIG. 2 represents a scanning electron microscope image of an inventive light-emitting carbonized conducting filament.

An inventive light-emitting element of the present invention provides an inexpensive and durable thermal marker that generates a unique infrared signature allowing identification and classification by a remote observer using an infrared imaging device. The inventive apparatus is applicable to many fields including military and security for the marking or identification of personnel and equipment that may be ground or air based. As such, the inventive light-emitting element has utility as a radiation source.

An inventive light-emitting element produces an emission of radiation with sufficient power for detection and measurement. The inventive sources have a broad envelope of radiant energy that slowly changes intensity as a function of wavelength. Illustratively, for identification and reference purposes, the light-emitting element has a fast rise and fall time relative to applied current. As used herein, the terms "radiation" and "heat" are used interchangeably. Preferably, the inventive element is an infrared emitter. As such, heat is generated by its operation.

Visualization of IR light-emitting markers is achieved by the use of optical equipment capable of detecting IR radiation. This system allows visibility and marking of a target or military personnel even under low visibility conditions. While many of these systems are highly sensitive, any IR source preferably produces radiation sufficient to be detected at range.

An inventive light-emitting element includes a substrate that is made of a polymeric material upon which at least one conductive filament is formed. A substrate is made from any plasticized polymeric material suitable for pyrolysis. Preferably, a substrate is made of a polyimide. Polyimide is a key component in many electronics as an insulating barrier and in flexible wiring. Polyimides in general are flexible, chemically and thermally resistant, insulating plastics. An example of a polyimide that is operable for use in the present invention is KAPTON (DuPont). KAPTON is a high-performance plastic made by DuPont and is the preferred starting material for the inventive light-emitting element. A preferred polyimide for use in the present invention is DuPont 500 HN KAPTON. KAPTON 500 HN is available in sheets and can be used as both an insulator and as a substrate upon which to form an inventive filament. The substrate thickness is optionally 127 micrometers, but other thicknesses are similarly suitable. Preferably, the substrate thickness is such that laser pyrolysis of the substrate will allow formation of a carbonized conducting filament while providing a layer of insulating material to remain chemically bonded to the filament. A substrate is preferably not so thin as to be breached during formation of a filament. Any maximum thickness for the substrate material is operable. It is preferred that a substrate material remain flexible.

It is appreciated that a polyimide is but one example of a suitable substrate for use in the instant invention. Numerous other materials such as polymeric materials including plastics are similarly suitable. Other illustrative examples of substrate material include polypropylene, polyethylene, polystyrene, polyurethane, methylacrylates, polymethylmethacrylate, and other polymeric materials such as those described in *Polyimides and other high temperature polymers: Synthesis, characterization and applications*, Vol. 1, Mittal, K. L., 2001. It is appreciated that other polyimides, or other plastic variants, are similarly operable in the present invention.

In a preferred embodiment, an inventive light-emitting element is formed by laser pyrolysis upon a polyimide substrate. A related method that is suitable for use to form a sensor substrate on polyimide is generally described in U.S. Pat. No. 6,796,166 incorporated by reference herein. As described herein, an inventive carbonized conductive filament can also illustratively be formed by laser pyrolysis. In a preferred embodiment, a carbonized conductive filament is laser carbonized onto a 3-by-1-centimeter piece of polyimide under an inert atmosphere within a reaction chamber as described with reference to FIG. 1.

FIG. 1 illustrates a schematic diagram 100 illustrating a design for the laser pyrolysis of a polymer for use as a filament and attached substrate, in accordance with a preferred embodiment of the present invention. As illustrated in diagram 100, an argon ion laser 102 can be utilized to pyrolyze a polymer located in a reaction chamber 120. The polymer located within reaction chamber 120 generally comprises a filament substrate upon which an emitter circuit can be patterned and formed. Argon ion laser 102 can comprise, for example, a COHERENT Innova 200 argon ion laser operating at 514 nm and can deliver an argon laser beam to reaction chamber 120 along a path from argon laser 102 to a first mirror 106, a telescope 107, a second mirror 108, a third mirror 110, a mechanical aperture 112, a lens 114, first and second servo mirrors 116 and 118 and finally to reaction chamber 120. Telescope 107 is used to Note that COHERENT is a registered trademark of Coherent, Inc., a company with headquarters in Santa Clara, Calif. It can be appreciated buy those skilled in the art that argon ion laser 102 can comprise other types of argon ion lasers.

Reaction chamber 120 provides nitrogen in an environment in which pyrolysis can take place. Reaction chamber 120 can be configured, for example, as a 10×5×8 cm black aluminum box with a removeably sealed lid and a rubber gasket thereof. Reaction chamber 120 can also include a ¼ A inch inlet and exhaust port to deliver an argon gas flow at approximately 500 ml/min throughout pyrolysis. One side of reaction chamber 120 may include a 1 cm thick quartz window. Those skilled in the art can appreciate, of course, that the aforementioned dimensions and components of reaction chamber 120 can be modified. Such dimensions and measurements are described herein for general edification and background purposes only and do not comprise limiting features of the present invention.

Reaction chamber 120 generally serves two purposes. First, the atmosphere surrounding the polymer contained within reaction chamber 120 can be controlled and hazardous byproducts of pyrolysis thereof can be exhausted safely. The emitter (not shown), which is located within reaction chamber 120 for pyrolization thereof, can be formed from a polymer such as KAPTON®. For example, 500 HN (127 μm thick) KAPTON® sheets can be utilized as received for use to form an emitter substrate in accordance with the present invention. An emitter pattern can thus be laser carbonized onto a 3×1 cm piece of KAPTON® under an argon atmosphere within reaction chamber 120 (i.e., a pyrolysis chamber).

A scanning controller 104 associated with a scanner can be utilized to control the laser pattern on the KAPTON® surface. An example of a scanner, which may be utilized in association with the present invention disclosed herein, is a General Scanning, Inc. DE 2000 scanner. Utilizing a set of computer controlled servo mirrors 116 and 118, a filament can thus be formed on the surface of the polymer, such as, for example, KAPTON®. Thus, a KAPTON® polyimide film can be utilized as a viable emitter substrate utilizing, for example, a single line design. KAPTON® is one example of a polyimide that can be laser-pyrolized to form conducting filaments.

The laser beam provided by argon laser 102 can be focused utilizing lens 114. Such a lens can be, for example, a $CaF_2$ plano convex lens having a focal length of approximately 50 cm. Carbonization of a typical sensor can be carried out with an energy density of 60 to 180 J/cm$^2$. Minimum carbonization energy is approximately 21 J/cm$^2$. Energy density is a function of scan speed, laser power, total number of scans, and the pyrolysis wavelength. Those skilled in the art can appreciate that this energy density may vary, depending on a desired implementation of the present invention disclosed herein. For example, a filament with a resistance of about 70 ohms per centimeter can be formed with an energy density of 140 J/cm$^2$ at a pyrolysis wavelength of approximately 496 nm. This energy density can be obtained by a single scan of a 1.70 watt TMOO, 496 nm continuous laser with a beam waist of 100 micrometers at a scan speed of 0.39 m/s. (Note: The beam waist is adjusted by moving the focusing lens 114 on a micrometer translation stage from an effective distance of 48-49.5 cm.) The emitter substrate can thus be optimized for sensitivity by varying the pyrolysis wavelength and energy density.

A 70 ohms per centimeter filament that is 0.8 centimeters long with each end of the filament attached with silver paint to a wire can be biased with 9 V of potential to produce peak emission between 8-12 microns.

Preferably, a light-emitting element is fabricated using polyimide by pyrolysis using a continuous laser system. An argon laser is preferred. However, it is appreciated that other laser systems, preferably short wavelength to ultraviolet wavelength emitting laser systems, are preferred for pyrolyzing and forming the inventive carbonized conductive filament. A carbonized conductive filament is illustratively formed from the trace of a focused laser beam. Other pyrolysis sources operative herein include rapid thermal processing, an electron beam, a pulsed laser, x-ray beam, and a gamma radiation source. It is appreciated that a patterned filament is readily formed with relative displacement of a beam and substrate, or with a stationary configuration and an interposed mask. By varying the energy density imparted, the properties of the filament are manipulated such as size, electrical resistance, and porosity. In a preferred embodiment, a continuous argon laser system operates from 365 nanometers to 514 nanometers. Energy density of the continuous argon laser system is controlled through adjustment of four variables—laser scan speed, laser focus, laser power, and laser wavelength. The filament can also be modified chemically to vary peak emission intensity.

In a preferred embodiment, a method of forming a carbonized conductive filament on a polyimide substrate is achieved by first placing a substrate material in a metal bracket within the sealed reaction chamber 120. The reaction chamber 120 preferably has a UV transmissive fused silica window. In a preferred embodiment, the substrate within a chamber is exposed to a gaseous fluid or liquid fluid other than air during pyrolysis, the fluid being present at reduced, ambient, or elevated pressure. With transient energy input to induce substrate pyrolysis, decomposition of the fluid is controlled. It is appreciated that a fluid optionally contains a dopant such as metal ions; inorganic nitrogen species; inorganic phosphorus species; organic dye; organometallics; or luminous proteins, such as GFP, that are incorporated into a filament during pyrolysis. Representative fluids operative herein illustratively include nitrogen, helium, argon, neon, ammonia, $C_1$-$C_{20}$ alcohols; $(C_7\text{-}C_{10}\ \text{alkyl})_2\text{-O}$; $C_3$-$C_{20}$ ketones; aromatic solvents such as benzene, toluene, and xylene, furans, glycols, water, and combinations thereof. Pyrolysis is optionally conducted during sonication to produce transient high temperature cavitation.

Polyimides, as a preferred substrate, commonly have an absorption band in the UV that trails off around 532 nanometers. As the polyimide absorbs the incident laser energy, the polyimide transforms from an insulating plastic to a conductive graphite-glassy carbon matrix. The spread of the laser energy and the energy flux, power as a fluctuation of time, determines the filament size and resistance. Thus, at the completion of the scan the carbonized conductive filament is chemically bonded to the remaining polyimide substrate.

In a preferred embodiment the laser beam provided by argon laser 102 can be focused by utilizing lens 114. The lens can be, for example, a $CaF_2$ plano-convex lens having a focal length of approximately 20 centimeters. Formation of a carbonized conductive filament is typically carried out with a continuous argon laser system at an energy density of between 1 and 250 joules per centimeter squared and preferably between 10 and 180 joules per centimeter squared. As energy density is a function of scan speed, laser power, total number of scans, and the pyrolysis wavelength, each of these parameters plays a role in providing the energy density and extent of carbonization of a substrate material. Formation of an inventive carbonized conducting filament can be optimized by altering pyrolysis wavelength, laser power, energy laser focus and laser scan speed. These constitute the components of energy density.

Wires are optionally attached to the ends of the inventive filament preferably using silver paint, but any type of conductive glue or binder is similarly operable. The wires are connected through a power source to form a circuit allowing the inventive conductive filament to conduct electricity. In operation, infrared radiation is produced by the application of a voltage across a carbonized conductive filament. This causes current to flow through the material and produce heat.

The ends of a carbonized conducting filament are optionally at the edge of a substrate. The ends may be at any point within the substrate. In one embodiment, formation of a first end of a filament will be made to penetrate the substrate such that a wire connection may be on a second side of the substrate. On the first side of the substrate resides the second end of the filament. Electrical connections can be placed in any position that is advantageous to the shape, design, or intended operation of an inventive element. Optionally, a bar electrode is used to connect to the end of a filament. A bar electrode, or pair thereof, allows current to pass through multiple carbonized conducting filaments simultaneously. It is appreciated that each carbonized conducting filament may have its own electrode attachment point or all filaments may meet at a single point for attachment to a wire.

Numerous geometric arrangements are available for the formation of a carbonized conductive filament upon a substrate. In one embodiment the arrangements are selected to create uniform heating across the surface of the substrate material, which produces uniform emission of infrared radiation. Alternatively a carbonized conductive filament is shaped into a geometric pattern. A geometric pattern can be in the form of an indicia such as a symbol or an alphanumeric character. A pattern can be a wave, a circular pattern, a chevron, or other shape. An inventive filament is preferably unbranched so as to pass current throughout the entire filament length. These geometric configurations are for illustrative purposes only and are not meant to be a limitation on the geometric configuration of a carbonized electrically conducting filament. A person of ordinary skill in the art will appreciate other configurations that are operable in the present invention.

A single substrate contains one or more carbonized conductive filaments. A single substrate may contain one, two, three, four, five, or more carbonized conductive filaments. A single substrate may contain as many as 1,000 carbonized conductive filaments. The number of filaments that may be placed on a substrate is a function of the substrate size, the size of the filament, the geometric arrangement of the filaments, the length of the filaments and the desired packing. The arrangement of multiple carbonized conductive filaments on a single substrate is defined by the technology used to generate the carbonized conductive filaments. Multiple filaments on a single substrate may be individually connected to different circuits and different power sources. Preferably multiple carbonized conductive filaments are arranged in a parallel configuration such that a single power source can simultaneously generate current through all of the inventive carbonized conducting filaments. Such an arrangement has the advantage that if a single or more than one carbonized conductive filament is damaged during operation the inventive light-emitting element will not be sufficiently compromised as to render it inoperable.

An inventive light-emitting element is optionally a series of substrates connected either in parallel or in series. Individual substrates and carbonized conductive filaments thereon may be identical or unique. Illustratively, four substrates that are different in nature such as by material or doping are connected in parallel or series. Such an arrangement allows for the production of uniquely identifying light-emitting elements. For example, multiple targets in a single area are optionally labeled with unique light-emitting elements such as to be distinguishable to one or more light sensors.

Optionally, the arrangement of substrates forms a geometric pattern. This way the size of the overall light-emitting element(s) is increased and the level of IR radiation is also amplified. Such a system can allow a light-emitting element comprised of multiple substrates, a single substrate, or multiple light-emitting elements to conform to the shape of an object so as to be visible from multiple angles simultaneously.

Figure 3:
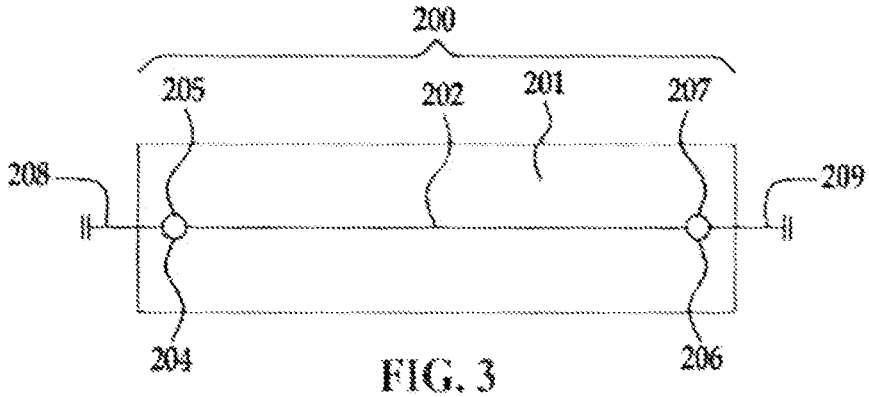
FIG. 3 represents a particular embodiment of a light-emitting carbonized conducting filament on a substrate.

FIG. 3 depicts a diagram of an inventive light-emitting element 200 design in accordance with a preferred embodiment of the present invention. One or more carbonized conductive filaments 202 can be formed from the substrate material 201 which is located within a reaction chamber. A carbonized conducting filament 202 can be formed in a weaving configuration, a concentrically encircled configuration, a linear configuration, or other arrangement. A first end 205 of an inventive carbonized conductive filament 202 comes into contact with conductive paint 204, such as silver, which in turn conies into contact with a wire end lead 208. The second end 207 of an inventive filament 202 comes into contact with a second wire lead 209 similarly affixed with a conductive paint 206. The approximate diameter of each silver paint area can be, for example, approximately 5 millimeters. One of ordinary skill in the art appreciates that although the conductive paint depicted in FIG. 3 at 204 and 206 are depicted as circular areas, such a circular configuration is presented herein for illustrative purposes only. The conductive paint may be arranged as a blotch or other irregular shape. It is appreciated that other conductive materials are also operative herein as conductive paints.

Figure 4:
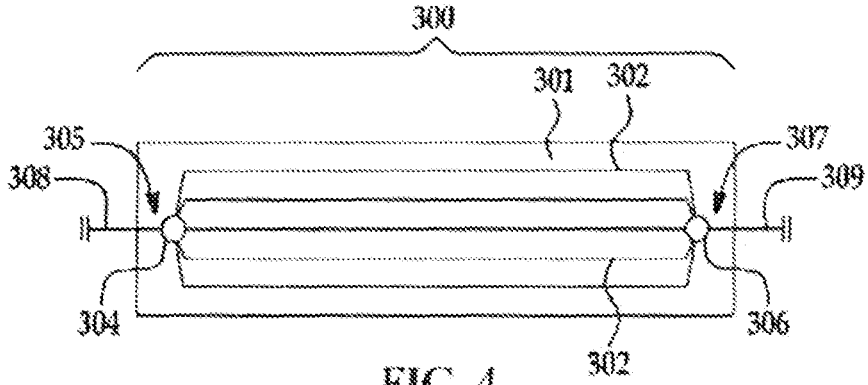
FIG. 4 represents an alternative arrangement for a plurality of inventive light-emitting carbonized conducting filaments on a single substrate arranged so as to form parallel circuits.

FIG. 4 depicts a diagram of an alternate arrangement of an inventive light-emitting element 300 wherein multiple carbonized conductive filaments are arranged in parallel on a single substrate. The arrangement in FIG. 4 depicts multiple carbonized conducting filaments 302 on a single substrate 301. It is appreciated that the five carbonized electrically conductive filaments 302 depicted on the single substrate 301 is for illustrative purposes only and that any number of such filaments are so constructed. The carbonized conductive filaments 302 as shown are arranged in parallel, with each meeting at a first end 305 affixed to a wire lead 308 by conductive paint 304. Similarly, at a second end 307 the filaments meet a single wire lead 309 affixed by silver paint 306. Considerations for a series or set of carbonized conductive filaments in FIG. 4 are similar to those in FIG. 3. Illustratively, the geometric pattern of each filament arranged in FIG. 4 is depicted as a wavy pattern but is not limited as such. Furthermore, multiple substrates with a plurality of carbonized conductive filaments thereon can also be arranged in series or in parallel such that a single light-emitting element may be constructed from a plurality of substrates.

A substrate is optionally doped with a dopant material that alters the conductivity, light-emitting properties or other characteristics of a carbonized conductive filament thereon. Doping is achieved either prior to formation of a filament or after formation of a filament. The doping process leads to entirely new filaments with diverse emission, chemical, or structural characteristics.

Doping of a substrate can be either by pretreatment or by post filament formation treatment. These reactants may become incorporated into the carbon matrix as they form. There are several ways to treat an inventive substrate such as a polyimide. Illustratively, polyimides can be doped with inorganic nitrogen species, metal salts, inorganic phosphorus species, concentrated sulfuric/acetic acid mixtures, luminous proteins, or combinations thereof. The polyimide surface can be layered with inorganic salts containing metal ions of main group metals, transition meals, or lanthanides like copper, nickel, silver, gold, arsenic, aluminum, or boron. The dopants operative herein are chemisorbed or physisorbed and change filament emission characteristics.

Optionally, a substrate with a carbonized conductive filament formed thereon is subject to a post-formation doping process. The function of a post-formation process is either to chemically modify or to adsorb substance onto the carbon matrix. Carbonized conductive filaments have significant graphite-like character. Many types of intercalation reactions are known for graphite and are operable for post-treatment doping reactions. Inventive carbonized conductive filaments also undergo oxidation/reduction reactions as a method for incorporating ions or metal centers into the structures. The highly porous filament surface can be layered with polymers that act as emission enhancers or modifiers.

It is appreciated that either a pre- or post-doping process is operable herein. It is further appreciated that both a pre- and post-doping process may be employed to further tune or otherwise alter the emission, physical, or chemical characteristics of an inventive filament or substrate.

A light-emitting element of the present invention optionally has structures in addition to a substrate with a carbonized conducting filament or multiple filaments thereon. Optionally, a light-emitting element has a backing. A backing can be any material suitable for affixing an inventive element to another surface or for providing support for such an inventive element. A backing layer optionally includes a contact adhesive fastener, a magnetic fastener, or a mechanical fastener. A backing may be secured to one side of an infrared emitting inventive element with a non-conductive adhesive. Fasteners such as hook-and-loop fasteners, adhesives, and magnets are operable herein. It is appreciate that other fasteners are similarly operable with the present invention. The material of the backing may be as flexible or as stiff as desired depending on the end use of the inventive light-emitting element. The appropriate fastener or backing layer material is chosen for a particular mounting application. Examples of mounting applications illustratively include clothing and helmets of personnel, harnesses for canine applications, and surfaces of equipment or other support structures.

An inventive light-emitting element may also include a heat dispersion material disposed on, above, below or near at least one carbonized conductive filament. A heat dispersion material is preferably electrically insulated such as with an insulating film. The heat dispersion material may be secured to a substrate on a back side or on the side containing a conductive carbonized conductive filament with a non-conductive adhesive. In one embodiment the heat dispersion material has a high heat conductance. In a further embodiment, the heat dispersion material has high infrared emissivity. Illustrative examples of heat dispersion materials include metal film, paint, and ink. During the operation of an inventive light-emitting element the heat dispersion material is heated by the infrared radiation emitted from an inventive carbonized conducting filament. This in turn produces a uniformly heated surface and a light-emitting element that emits uniform infrared radiation.

A light-emitting element of the present invention also optionally includes a cover. A cover is preferably transparent to infrared radiation. Preferably, a cover layer is arranged on the side of a carbonized conductive filament such that infrared radiation emitted therefrom can pass through such a cover layer. Any material that is transparent to infrared radiation is optionally operable as a cover layer. Illustrative examples include polycarbonate or borosilicate glass. Preferably, a cover layer is flexible such that affixing a light-emitting element to an irregular surface does not disturb or compromise the integrity of the cover. In one embodiment, a bubble-filled plastic film of polyethylene is operable herein. It is appreciated that other materials are used.

An inventive light-emitting element optionally includes an infrared or heat-reflective layer. A reflective layer may be positioned between a substrate and a backing layer. In one embodiment, a heat-reflective layer may be a metallized plastic film. In another embodiment, the heat-reflective layer is a metallic coating on a heat-insulating layer.

An inventive light-emitting element illustratively operates in the near infrared to mid infrared range, preferably from 0.5 to 50 micrometers. In one embodiment infrared radiation is emitted between about 0.75 and 20 micrometers. More preferably, wavelengths are in excess of 2 micrometers.

The carbonized conductive filaments of the present invention can vary in length and size but are generally 3 centimeters or less. An inventive light-emitting element is intended for use as a low power (illustratively 3.5 W max), broad spectrum source for thermal identification or reference or as an infrared emission substrate. A filament preferably has a relatively high input to output power ratio of one percent or greater. Infrared emission is improved or otherwise altered and tuned through the addition of doping materials either prior to or following formation of a carbonized conductive filament on a substrate.

Power characteristics of an inventive element can be tuned by altering the size or other dimensions of a carbonized conducting filament on a substrate. In a preferred embodiment, the width of a conductive filament is from about 1 micrometer to 500 micrometers. A filament typically has a height that is about from 1 micrometer to 200 micrometers. Other parameters illustratively including density of a filament or chemical characteristics of the filament are altered to optimize or otherwise change the IR emitting properties of an inventive light-emitting element.

An inventive light-emitting element is intended to be used alongside or in other applications relative to those optimal for a tungsten filament, xenon arc, or silicon carbide light-emitting markers which are generally used as high emission sources. Surprisingly, the inventive light-emitting element has several strengths in its design such as passing of high current through a carbon conducting filament creates a lower power and higher efficiency emitter that can be produced at low cost.

The infrared emission from a light-emitting element is preferably controlled by the amount of current applied through the filament. Strong infrared emission is achieved in the 3 to 14 micron band with as little as 12 mA and 3 volts. Emission is either pulsed or continuous. The full emission response time is dependent on the current and the filament properties such as size, resistance, and porosity but is generally less than 1 second for the 8 to 14 micron region.

Numerous examples of carbonized conductive filaments are operable as related to the present invention. There are a wide variety of forms with widths from several microns to several hundred microns and heights from several microns to 200 microns. Porosity structures range from the lattice structures covered with thin skins to open cavities with nanoscale hairs. Resistance generally correlates to size from thousands of ohms per centimeter to less than 100 ohms per centimeter with greater filament volume correlating with lower resistance. In a preferred embodiment a carbonized conductive filament has large volume and thus low resistance to optimize efficiency.

An inventive light-emitting element has several advantages over the prior art. Advantages include higher input to output power efficiency, inexpensive and easy fabrication, fast response and decay times, improved durability in an oxidative environment such as air, and the ability to tune IR emission through applied current. Additionally, the use of chemical or other doping agents improves emission strength and peak emission band and allows fine-tuning thereof. Further, doping occurs either pre- or post-processing to further optimize the IR output of an inventive light-emitting element. A carbonized conductive filament, due to the ease of production as described herein, can easily be integrated as part of an electronics device such as those using standard polyimide substrates.

Chemical doping by both pre-treatment and post-treatment is possible. Intercalation ions cause a shift in the emission band and a change in emission intensity. In one embodiment a carbonized conducting filament surface is coated with compounds that act as both a filter and an emission enhancer depending on the composition.

Light-emitting elements are optionally arranged in a one-dimensional or a two-dimensional array. Multiple substrate shapes are operable herein. A substrate shape may correlate with the shape and configuration of an array of multiple light-emitting elements. Arrays or substrate shapes of any design may be used. As used herein, array denotes the grouping of plural elements, including elements spaced at equal and unequal intervals.

The present invention disclosed herein includes a light-emitting element that further includes a substrate that is generally a polymer upon which at least one carbonized conductive filament is formed. A carbonized conductive filament is formed on a substrate by any means operable such as by a pyrolysis reaction using a laser illustratively an argon laser. Preferably, a substrate is a polyimide. An inventive substrate is also preferably an insulator.

Formation of a carbonized conducting filament is preferably in an inert atmosphere. Illustrative atmospheres operable herein include oxygen, nitrogen, helium, or mixtures thereof. Preferably an atmosphere is nitrogen. More preferably an atmosphere is a mixture of oxygen and nitrogen.

An inventive light-emitting element emits infrared radiation in a band between about 1 and 20 micrometers. Preferably, an emission response time of less than 1 second is achieved.

In a preferred embodiment, a substrate is doped with either a pre-processing or post-processing dopant.

An inventive element preferably contains a carbonized conducting filament with a width from about 1 micron to about 500 microns. Preferably a carbonized conducting filament has a height from about 1 micron to about 200 microns. Such a carbonized conducting filament preferably has an input to output power ratio greater than 1 percent.

A carbonized conducting filament on a substrate can be arranged in numerous geometric shapes. Illustrative examples include a linear design, a shape, a symbol, or an alphanumeric character.

A light-emitting element optionally includes other structures such as a backing or a cover of infrared transparent material. An inventive element may further include a heat-reflective layer.

A single substrate optionally includes a plurality of carbonized conducting filaments. The arrangement of the carbonized conducting filaments may be in series or in parallel. Further, the orientation of any single carbonized conducting filament may comprise any shape. Preferably, a single substrate contains a plurality of carbonized conducting filaments arranged as to form parallel circuits.

Patent documents and publications mentioned in the specification are indicative of the levels of those skilled in the art to which the invention pertains. These documents and publications are incorporated herein by reference to the same extent as if each individual document or publication was specifically and individually written herein.

The foregoing description is illustrative of particular embodiments of the invention, but is not meant to be a limitation upon the practice thereof. The following claims, including all equivalents thereof, are intended to define the scope of the invention.

What is claimed is:

1. A light-emitting element, comprising:

a substrate formed of a polymer; and at least one carbonized conductive filament formed from said substrate and emitting infrared light upon being biased.

2. The light-emitting element of claim 1, wherein said polymer is a polyimide film.

3. The light-emitting element of claim 1, wherein said polymer is an electrical insulator.

4. The light-emitting element of claim wherein the infrared light has at least one wavelength between 0.5 and 50 micrometers.

5. The light-emitting element of claim 1, wherein, said emitting infrared light upon being biased has an emission response time of less titan 1 second.

6. The light-emitting element of claim 1, further comprising a dopant in said at least one carbonized conductive filament, wherein said dopant is one or more of inorganic nitrogen species, metal salts, inorganic phosphorus species, concentrated sulfuric/acetic acid mixtures, luminous proteins, or combinations thereof.

7. The element of claim 1, wherein said at least one carbonized conducting filament has an input to output power ratio greater than 1 percent.

8. The element of claim 1, wherein said filament is formed as an indicia of a symbol or an alphanumeric character.

9. The element of claim 1, further comprising a backing.

10. The element of claim 1, further comprising a cover of infrared transparent material.

11. The element of claim 1, wherein said at least one carbonized conductive filament comprises a plurality of carbonized conducting filaments.

12. The element of claim 11, wherein said plurality of filaments are arranged as to form parallel circuits.

13. A light-emitting element, comprising:

a substrate formed of a polymer; and at least one unbranched polymer carbonized conductive filament formed from said substrate and emitting a wavelength of light upon being biased.

14. The element of claim 13, further comprising a dopant.

15. The element of claim 14, wherein said dopant is selected from the group consisting of a solvated nitronium metal salt, a concentrated sulfuric/acetic acid mixture, metal ions, and combinations thereof.

16. The element of claim 13, wherein said at least one carbonized conductive filament comprises a plurality of carbonized conductive filaments.

17. The element of claim 16, wherein said plurality of carbonized conductive filaments are arranged as to form parallel circuits.

* * * * *